United States Patent [19]

Bledsoe

[11] 4,422,492

[45] Dec. 27, 1983

[54] INSULATING SHADE DEVICE

[76] Inventor: Billy M. Bledsoe, Rte. 2, Fulton Rd., Corryton, Tenn. 37721

[21] Appl. No.: 175,314

[22] Filed: Aug. 4, 1980

[51] Int. Cl.[3] ..... E06B 3/94; A47H 5/00

[52] U.S. Cl. ..... 160/84 R; 160/32; 160/90

[58] Field of Search ..... 160/84 R, 32, 34, 35, 160/115, DIG. 7, 290 R, 238, 344, 348, 267, 90

[56] References Cited

U.S. PATENT DOCUMENTS

| | | | |
|---|---|---|---|
| 1,289,281 | 12/1918 | Shaft | 160/84 R |
| 2,247,260 | 6/1941 | Stone | 160/84 R |
| 2,254,820 | 9/1941 | Donner | 160/84 R |
| 3,196,935 | 7/1965 | Christensen | 160/267 |
| 3,946,788 | 3/1976 | Van Muyen | 160/84 R |
| 4,095,639 | 6/1978 | Ryan | 160/84 R |

*Primary Examiner*—Philip C. Kannan
*Attorney, Agent, or Firm*—Pitts and Kesterson

[57] ABSTRACT

An improved insulating shade device is provided for increasing thermal resistance and minimizing convective drafts at windows. The device includes a multiplicity of insulating members proportioned for covering a section of the window pane. The insulating members in one embodiment are joined by a suitable cover such that abutting edges of adjacent insulating members pivot with respect to each other. The device is mounted by attaching a support unit to the lintel or upper portion of the window frame. This support unit carries the shade and, in this connection, the upper end portion of the shade is joined with the support unit. Means are provided for drawing the shade to its folded position such that it is stored in a compact manner below the support unit.

4 Claims, 8 Drawing Figures

INSULATING SHADE DEVICE

This invention relates to insulating window shades and more particularly concerns a shade which can be collapsed for storage purposes and drawn or opened for insulating the window and for creating a static air panel or pocket which enhances its insulating effect.

The window portions of commercial and residential buildings are a common source of heat loss, particularly where the glass window is thermally untreated due to economic parameters prevalent at the time of construction. A number of prior art patents disclose systems which are designed to reduce the energy loss through a glass window. For example, see U.S. Pat. Nos. 1,548,523; 4,010,554; 1,508,759; 1,577,574; 1,927,272; 2,313,659; 2,314,784, and 2,548,041. Each of the mentioned patents discloses a type of window shade or appliance for increasing the thermal resistance of the window or glass area. However, the known prior art devices suffer various disadvantages. For example, certain of the devices are expensive to manufacture and require modifications of the window support structure. Other devices are designed to fit only particular types of windows and are not suitable for including a shade which has a high insulation or thermal resistivity factor particularly since such a shade is usually more difficult to store in a small space or valance area.

Accordingly, it is the object of this invention to provide an improved insulating shade device. Further object of the present invention is to provide an insulating shade device which will provide both draft resistance to minimize the heat loss effects from convection currents and also provide significant thermal resistance which can not be realized by the use of storm windows or the like. Additionally, it is an object of the invention to provide an insulating shade device which is inexpensive to manufacture and easy to install. Yet another object of the invention is to provide an insulating shade device which can be secured and tensioned to define a static air panel between the shade and the window pane to enhance the insulating effect thereof. Yet another object of the invention is to provide an aesthetically pleasing shade which can be easily cleaned. Other objects and advantages of the invention will become apparent upon reading the following detailed description along with the drawings in which:

DESCRIPTION OF THE PREFERRED EMBODIMENT

Figure 1:
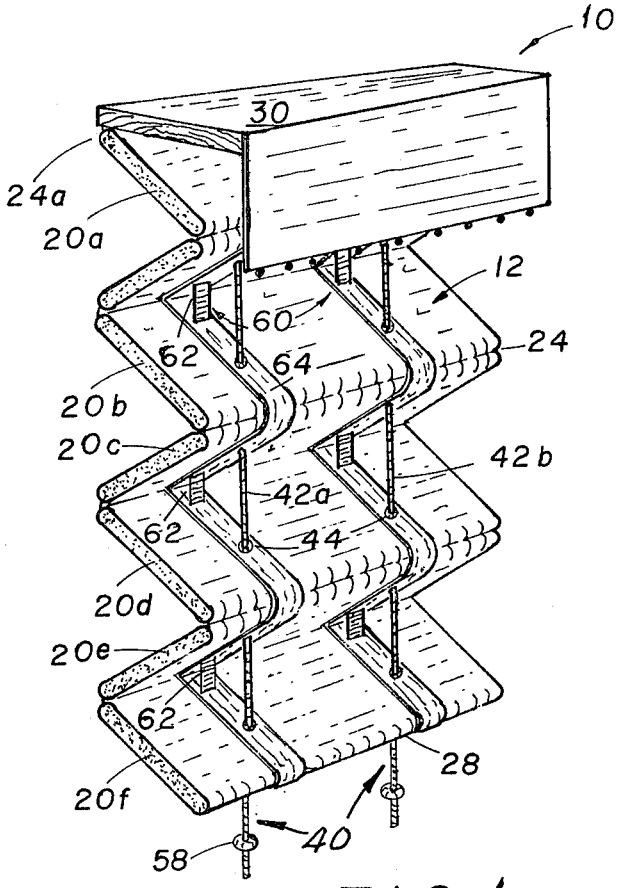
FIG. 1 is a perspective view of an insulating shade device embodying various features of the invention.
Figure 2:
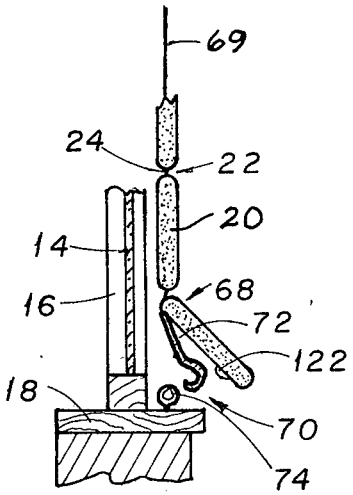
FIG. 2 is a sectional side elevation view of the end portion of the shade as it is being secured proximate the window sill.

Preferring now to the drawings, an insulating shade device constructed in accordance with various features of the invention is indicated generally at 10 in FIG. 1. This insulated shade device includes a shade generally indicated at 12 which is proportioned for covering the window pane 14 (see FIG. 2) or panes 14*a–b* for a sliding window (see FIG. 4). The pane 14 is mounted in a window frame 16 having a pair of uprights and cross members which receive the perimeter of the pane. The lower portion of the frame is supported by the window sill 18.

The shade includes a plurality of insulating members 20 having a preselected "R" value (thermal resistivity). Each of these insulating members is fabricated from a rigid or semirigid material having a preselected width which facilitates folding as will be described in greater detail hereinafter, and a length which is proportioned for covering a section of the window pane. Preferably, the length of the insulating members 20 is such that it overlaps a portion of the upright window pane frame members to enhance the insulating effect and form a seal therewith.

Means are provided for joining the insulating members together such that the shade can be folded for storage and unfolded by creating an insulating cover over the window. In the preferred embodiment, the insulating member joining means is generally indicated at 22 and comprises a pair of flexible cover sheets which receive at preselected spaced locations, the insulating members 20 therein between the folds or fold webbing indicated at 24 between adjacent longitudinal edges of the insulating edges. More specifically, the cover sheets comprising the joining means 22 are secured together as by sewing along the folds 24 such that the cover sheets defined pockets for receiving the insulating members. In this connection, the insulating members are pivotally secured to each other and are encased in a soil resistant and flexible cover. These cover sheets which comprise the joining means may include one single sheet which is folded at the location 28 along the leading or lowermost edge of the shade (See FIG. 1). As necessary or desired, the opposite end portions of the insulating members along the sides of the shade can be covered to assist in preventing the collection of dirt or soil.

Figure 4:
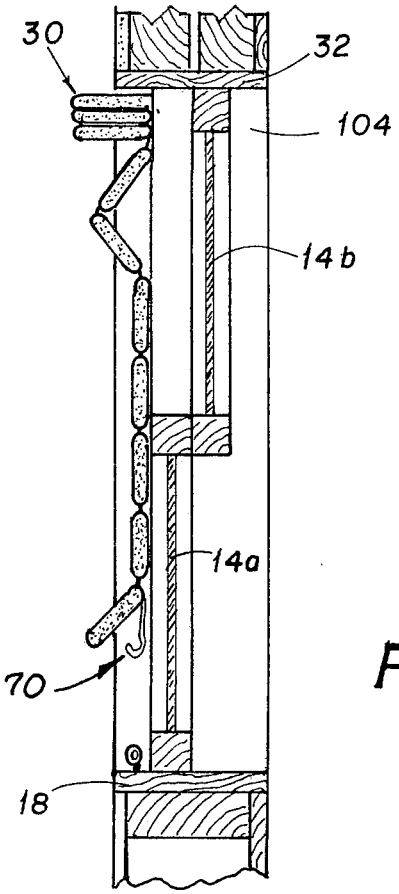
FIG. 4 is a sectional side elevation view of the shade device mounted on the lintel proximate the upper portion of the window frame.

In the preferred embodiment, the shade is mounted proximate the lintel of the window. In this connection, a support unit generally indicated at 30 in FIG. 1, is connected to the upper portion of the shade proximate the fold or webbing 24*a* as illustrated in FIG. 1. This support member 30 is secured to the lower side of the window lintel 32 as indicated in FIG. 4. This support member 30 in the embodiments illustrated in FIGS. 1 and 4 approximates the cross sectional outline of the individual insulating members 20 such that upon folding the shade, the insulating members rest within the compact volume directly below the support unit.

Means generally indicated at 40 are provided for drawing the shade to its folded position for storage below the under side of the supporting unit 30. For example, one suitable means for drawing the shade to its folded position is illustrated in FIG. 1. This drawing means comprises a pair of substantially parallel disposed cords 42*a* and 42*b* which extend through axially aligned openings 44 provided at preselected locations in each of the insulating members and cover sheets. As these cords are drawn, as by pulling the draw string 46 (See FIG. 3), the lowermost end portions of the cords 42*a–b* which are attached to the lowermost insulating member 20*d*, are pulled upwardly such that the shade folds approximate each of the folds. As this lowermost insulating member is drawn upward, the insulating members are stacked below the supporting unit 30 for storage purposes and the drawstring 46 is secured to maintain the shade and the insulating members in the stored position.

Figure 3:
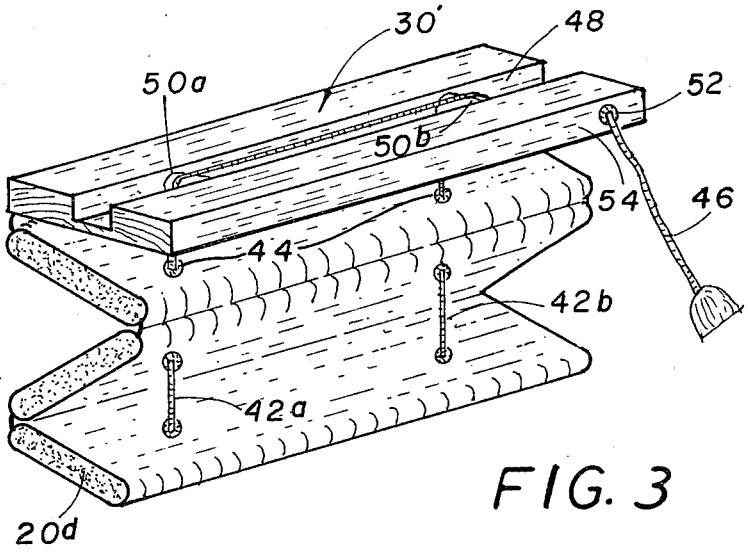
FIG. 3 is a perspective view showing one embodiment of the supporting unit which carries the end portion of the shade.

In the embodiment illustrated in FIG. 3, the support unit 30' comprises a cross member having an elongated groove opening 48 onto the upper surface of the cross member. The groove in the illustrated embodiment runs substantially along the longitudinal axis of the cross member or support unit and is designed for receiving a portion of the means for drawing the shade to its folded location. More specifically, the cords 42*a* and 42*b* are secured at the lower end portion to the lowermost insulating member 20*d* and extend through axially aligned openings 44 as described hereinabove and through axially aligned openings in the support member which open into the groove (Not Shown). These openings in the support member slidably receive the drawstrings which pass over guides or dowell rollers 50*a–b* horizontally disposed within the longitudinal groove 48 at spaced locations proximate the openings at the support members. The drawstring 46 which may be joined with or comprises the drawstrings or cords 42*a–b* passes through an opening 52 in the face 54 of the support unit. This opening 52 communicates between the face 54 of the support unit and the groove 48 and slidably receives the drawstring 46 therethrough. The embodiment of the support unit shown in FIG. 3 is particularly suitable for use with a large shade.

Means are provided to position the shade at any stage of deployment such that a preselected portion of the window pane can be covered. In the embodiment illustrated in FIG. 1, the shade position control means 58 comprises a slip ring 58 or preferably a pair of slip rings which are mounted on the cords 42 and engage the underside of the lowermost insulating member when the shade has been unfolded to its desired length.

Means are provided in one embodiment of the invention to control the location of the folds such that operation of the drawstrings or drawing means causes the shade to be positioned below the support unit in a compact and neat fashion. In the embodiment illustrated in FIG. 1, fold controls indicated generally at 60 connect adjoining faces of the insulated members for purposes of pulling the insulating members together to control the proper location of the fold. In the illustrated embodiment, the fold controls comprise elastic strips which are secured at their opposite end portions and in pairs to adjacent insulating members and serve to bias these insulating members together for purposes of determining the location of the fold. More specifically and as shown in FIG. 1, the opposite end portions of the elastic members 62 are secured to a reinforcing binding or strip 64 which is in turn secured on the joining means 22 or cover sheets. As the unfolded shade is drawn for storage, these elastic members bias the insulating members and their covers towards each other at preselected locations for determining the direction and pattern of the shade folding.

An important feature of the invention is the provision of a static air column or panel between the window pane 14 and the shade 12 upon the shade being unfolded. This static air column enhances the insulation effect of the shade. In one embodiment of the invention, the leading end portion 68 of the shade is secured proximate the window sill such that the shade in its unfolded position can be maintained in a substantially vertical plane 69 (See FIG. 2) for purposes of creating a static air pocket between the shade and the window pane. More specifically, the means for securing the lower portion of the shade is indicated generally at 70 in FIGS. 2 and 4. The illustrated securing means comprises a latch 72 which cooperates with a hook or eyelet 74 mounted on a sill. The latch 72 carried by the end portion 68 of the shade can be received at its distal end portion in the eyelet 74.

Figure 5:
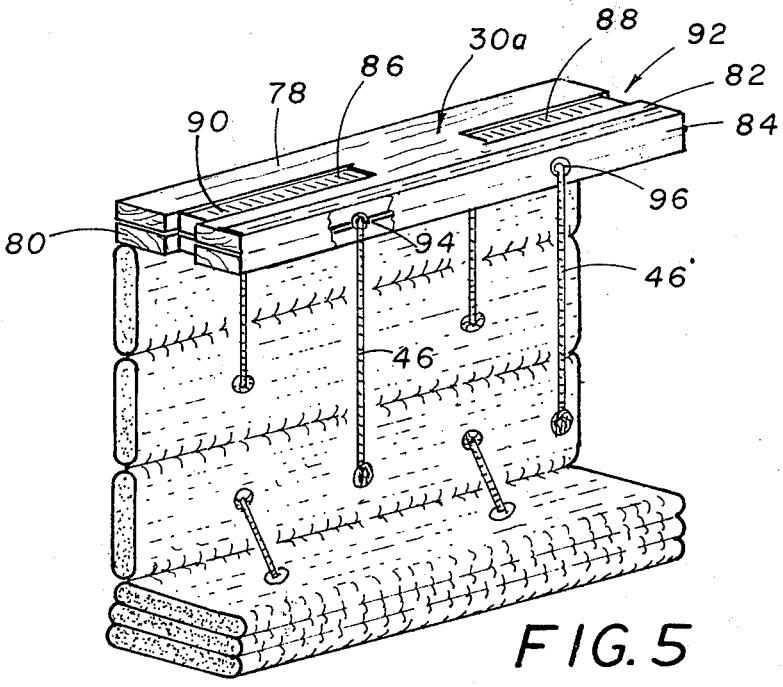
FIG. 5 is a perspective view illustrating a further embodiment of the support unit and means for drawing the shade.

Subsequent to connecting the securing means, the shade is drawn upwardly by shade tension means for placing tension on the shade to maintain it in a substantial vertical plane, thereby creating a static air pocket between the shade and the window pane which has a substantially uniform depth. Suitable shade tension means are illustrated in the alternate embodiment of the support unit illustrated at 30*a* in FIG. 5. In this embodiment, the support unit includes a pair of cross members 78 and 80 having substantially identical outlines. These cross members are joined together along the leading edge 82 of the support unit by suitable means such as a flexible strip 84 which allows the edges of the cross members to pivot with respect to each other. Alternatively, a single or pair of tension hinges could be utilized as will be described in greater detail hereinafter. In the embodiment illustrated in FIG. 5, the shade tension means comprises a pair of tension members 86 and 88 which are secured to the top surface of support member 78 and the lower surface of the member 80 as illustrated. In this connection, each end portions of the cross members is provided with a recessed area as illustrated in FIG. 5 at 90 and 92 for purposes of receiving the elastic member as it is wrapped about the end portions of the support unit. The elastic members 86 and 88 serve to bias the cross members together and maintain the cross members in this position during normal operation. Upon securing the end portion 68 of the shade proximate the window sill, the biasing members or elastic members serve to allow the length of the shade to expand slightly until the securing means 70 is engaged, that is the latch 72 is placed in the eyelet 74. The elastic members then bias the cross members towards each other placing the shade under tension and maintain the shade in a substantially vertical plane as the shade is slightly retracted under the biasing forces of the biasing members or elastic members.

In the embodiment of the support unit 30*a* illustrated in FIG. 5, the drawstrings 46 and 46' extend through openings or mating channels 94 and 96 provided in the cross members. These channels lead to a substantially vertical opening through which the drawstrings extend and are connected with the portions of the string extending through the openings in the shade.

Figure 6:
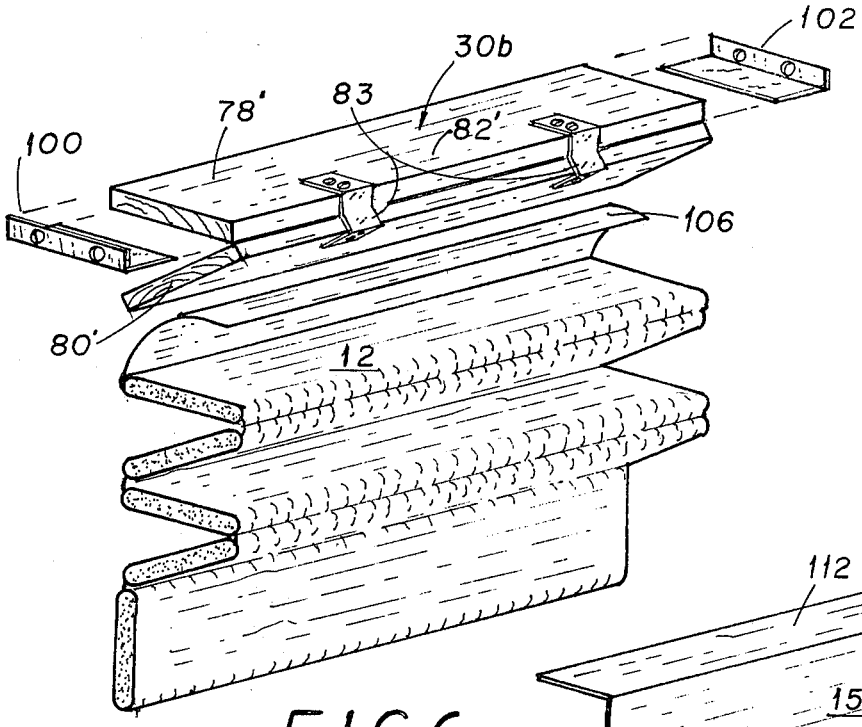
FIG. 6 is a perspective view showing yet another embodiment of the support unit and mounting bracket for securing the support unit and shade proximate the window.

A further embodiment of the support unit is illustrated at 30*b* in FIG. 6. This support unit includes a pair of cross members 78' and 80' which are hingedly connected along the leading edge 82' of the support unit with a pair of tension hinges 83 which serve as shade tension means. A pair of brackets or window frame holders 100 and 102 include a section which is received between the members 78' and 80' and gripped thereby for purposes of securing the support unit to the upright window frame members as illustrated at 104 in FIG. 4. In this connection, the support unit can be mounted for operation without securing it directly to the lintel.

The support unit illustrated in FIG. 6 also illustrates an alternate embodiment for securing the upper end portion 106 of the shade 12 to the support unit. In this connection, the upper end portion or binding of the shade comprises a section of the joining means or cover which does not include or house an insulating member. This end portion 106 is received between the members 78' and 80' secured to member 80' as with a staple and upon closing these members, the end portion 106 is secured therein.

Figure 7:
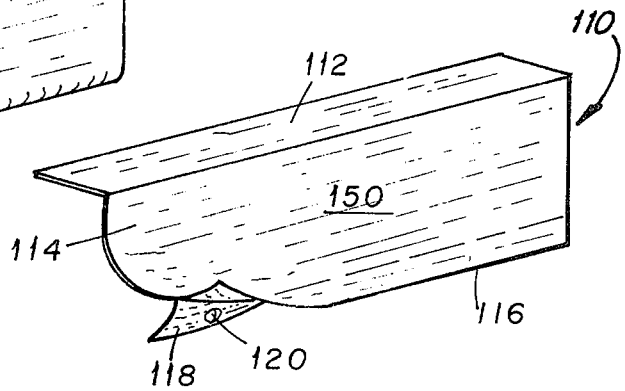
FIG. 7 illustrates a cover which is designed to be aesthetically pleasing and further secure the shade in its folded position.

Upon drawing the shade to its closed position, means are provided for securing the shade at the location immediately below the support unit with the insulating members stacked upon each other. It will be recognized that the shade position control means such as the slip rings 58 in FIG. 1, serve to secure the shade in its closed or folded position proximate the support unit. In an alternate embodiment, a valance 110 (See FIG. 7) is provided to secure the shade in its closed position and for decorative purposes. This valance 110 is secured along the section 112 to the upper surface of the support unit such that the binding 114 overhangs the support unit and covers the drawn shade. This binding includes a leading edge 116 and a securing strip 118 which includes, in the illustrated embodiment, means for being joined to the underside of the lowermost portion 68 of the window shade. More specifically, snaps as illustrated at 120 are joined to cooperating members 122 (See FIG. 2) upon drawing the shade to its raised position.

Figure 8:
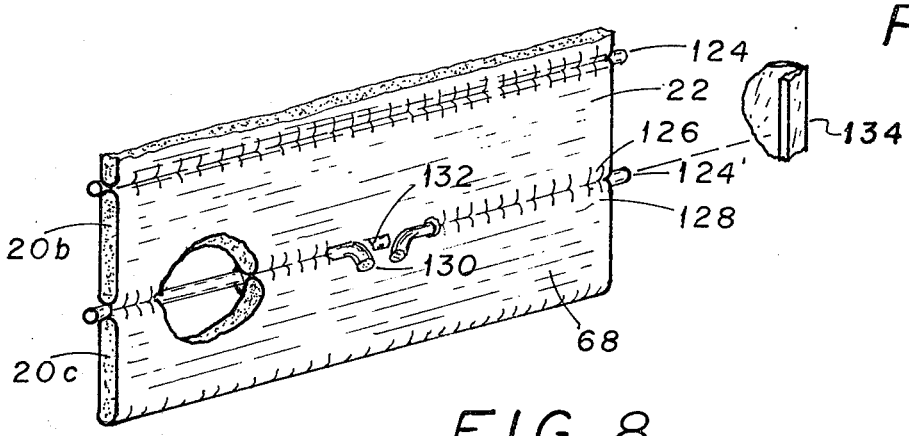
FIG. 8 illustrates an embodiment of the shade in which the abutting edge portions of adjacent insulating members are joined by a suitable rod for pivoting purposes.

FIG. 8 illustrates an alternate embodiment for connecting abutting marginal edges of the insulating members and/or the insulating member covers to each other such that the insulating members can be folded for closing and storage of the shade. In the embodiment illustrated in FIG. 8, the folds are formed with a plurality of spaced rods 124 which are fed through loops 126 and 128 defined by the cover or joining means 22 proximate the adjacent or abutting edges of the insulating members which are joined by the rods. More specifically, the rod 124 is fed through the loops 126 and 128 defined by the joining means 22 proximate the webbing 24 which provides the pocket for receiving the insulating members **20*b* and 20*c***, and serves as a pivot location for folding the shade.

FIG. 8 also illustrates a rod 124' which can be used with certain shades, particularly longer shades, for securing the lower end portion 68 of the shade to the window frame proximate the sill. This rod 124' includes opposite end portions which extend beyond the marginal edges of the shade and can be received in suitable recesses (not shown) in the window frame uprights for securing the shade. The rod 124' includes a center press release 130 to decrease the length of the rod and disconnect its end portion from the frame recess when it is desired to collapse the shade. The compression spring 132 returns the rod to its extended position such that the rod can slide in a track 134 illustrated diagramatically, and carried by the window frame uprights.

From the foregoing detailed description, it will be recognized that a improved insulating shade device has been shown and described which incorporates numerous advantageous features. For example, the illustrated insulating shade device is inexpensive to construct and can be installed readily in almost any conventional window. The shade can be deployed or unfolded to a preselected location and secured in such a position by a shade position control. Means are provided for placing the shade under tension subsequent to securing the lowermost end portion of the shade proximate the window sill such that the static air pocket is substantially uniform. Moreover, the deployed shade maintains a neat appearance since it is flattened by the biasing effect of the shade tension means.

While the preferred embodiment has been shown and described, it should be understood that there is no intent to limit the invention by such disclosure, but rather it is intended to cover all modifications and alternate constructions following within the spirit and scope of the invention as defined in the appended claims.

I claim:

1. An insulating shade device for increasing the thermal resistance and minimizing convective drafts at windows having a pane and a frame for supporting said pane, said frame including an upper cross member or lintel, a lower cross member or sill, and uprights, said device comprising:

a shade having a multiplicity of insulating members, each of said members being proportioned for covering a section of said pane, said shade including means for joining said members such that the shade can be folded for storage and unfolded for creating an insulating cover over the window, said shade defining an upper end portion and a lower end portion;

a support unit joining said upper end portion of said shade and suitable for attaching said shade proximate said upper lintel, said support unit including an upper cross member and a lower cross member, said cross members being pivotally connected along one edge of said unit, said support unit further including shade tension means for biasing said lower support member towards said upper support member, whereby said shade is placed under tension and maintained in a substantially vertical plane upon securing the lower end portion of said shade to said window sill;

means for drawing said shade to its folded position; and means for positioning the shade at any stage of deploying such that a preselected portion of the window can be covered.

2. The insulating shade device of claim 1 including means for securing the lower portion of said shade to said window sill when said shade is unfolded thereby creating a static air panel behind said shade and between said shade and said window pane.

3. The insulating shade of claim 2 including fold control means for controlling the location in which said shade is folded while said means for drawing said shade to its folded position is operated whereby the pattern of the folds between said insulating members is preselected.

4. The insulating shade of claim 1 wherein said means for positioning said shade at any stage of deployment comprises at least one slip ring carried by said means for drawing said shade to its folded position, said slip ring serving to engage and fix the position of the insulating member proximate the lower end portion of said shade, thereby securing said shade at a preselected stage of deployment.

* * * * *